United States Patent [19]

Arvela

[11] 4,102,679

[45] Jul. 25, 1978

[54] POWDER METALLURGIC MANUFACTURING PROCESS

[75] Inventor: Aukusti Arvela, Helsinki, Finland

[73] Assignee: L.A. Levanto Oy, Pikkulinnunreitti, Finland

[21] Appl. No.: 747,925

[22] Filed: Dec. 6, 1976

[30] Foreign Application Priority Data

Dec. 23, 1975 [FI] Finland ..... 753648

[51] Int. Cl.[2] ..... B22F 3/14; H05B 3/60

[52] U.S. Cl. ..... 75/226; 219/118; 219/144; 425/78; 219/78.01; 219/117.1

[58] Field of Search ..... 75/226; 425/78; 219/117 R, 118, 201, 243, 78, 149

[56] References Cited

U.S. PATENT DOCUMENTS

| | | | |
|---|---|---|---|
| 1,896,853 | 2/1933 | Taylor | 75/226 X |
| 1,896,854 | 2/1933 | Taylor | 219/149 |
| 2,089,030 | 8/1937 | Kratky | 75/226 X |
| 2,133,495 | 10/1938 | Willey | 75/204 |
| 2,149,596 | 3/1939 | Gillett et al. | 75/226 |
| 2,195,297 | 3/1940 | Engle | 75/226 X |
| 2,355,954 | 8/1944 | Cremer | 75/226 X |
| 2,372,605 | 3/1945 | Ross | 219/78 X |
| 2,938,998 | 5/1960 | Wilson | 219/149 |
| 3,069,261 | 12/1962 | Kilby et al. | 219/149 X |
| 3,445,625 | 5/1969 | Hetherington | 219/149 |
| 3,546,413 | 12/1970 | Ishizuka | 219/149 X |
| 3,665,151 | 5/1972 | Piper | 219/149 |
| 3,727,028 | 4/1973 | Kuratomi | 219/149 |
| 3,778,586 | 12/1973 | Breton | 219/117 R X |

OTHER PUBLICATIONS

Goetzel, C. G. *Treatise on Powder Metallurgy* vol. 1, pp. 480–481, Interscience, N.Y. 1949.

*Primary Examiner*—Richard E. Schafer
*Attorney, Agent, or Firm*—Woodling, Krost, Granger and Rust

[57] ABSTRACT

An improvement in a powder metallurgic manufacturing process where metal powder is compressed and heated in a mould and heat is produced by conducting electric current through the mould and the metal powder as well as through at least one electrically resistive fireproof body in actual contact with the mould where heat produced in the body is transferred to the mould and the metal powder. The improvement comprises maintaining electric tension between 2 and 200 volts; the current efficiency per unit volume of the mould between 20 and 200 W/cm$^3$; and the resistivity of the electrically resistive fireproof body between 0.03 and 100 ohm × cm.

4 Claims, 2 Drawing Figures

POWDER METALLURGIC MANUFACTURING PROCESS

Figure 1:
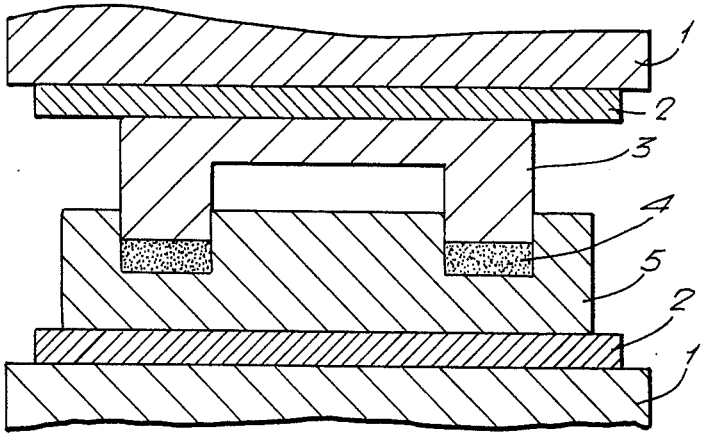

This invention relates to a powder metallurgic process by means of which metal powder or metallic powder mixture is compacted and heated in a mould. This metallic powder mixture consists of metal powders and such substances as diamond, boron nitride and other abrasives. At the beginning of the process the mould and the metallic powder mixture are cold. The heat is produced by conducting electric current through the mould and the metallic powder mixture.

The hot-pressing, i.e. simultaneous compacting and heating, has the advantage of great freedom for choosing the compact composition and therefore the possibility for getting special characteristics in the compact. The sintering time is short and the temperature is relatively low, which properties can be most important when the metallic powder mixture consists of such evaporable or reactive substances as zinc, graphite, diamond or similar materials.

The hot-pressing process has also disadvantages, e.g. expense due to the mould and difficulties in transferring heat to the compact. The moulds are of graphite, steel or hard metal. Only in a few cases can a graphite mould be heated simply by conducting current through it. The current in that kind of short circuit is very high (6000 . . . 10.000 A) and reciprocally the tension is very low (0.3 . . . 1 V).

Steel and hard metal moulds, where the resistivity is about 25 times lower than in graphite, should be heated to get the same efficiency with 5 times higher current and 5 times lower tension. It is so difficult to obtain these conditions that generally a high frequency electric heater or a separate furnace is chosen. Graphite moulds are often heated in the same way.

This invention aims at a simplification of the use of moulds in hot-pressing. The characteristics of the invention are to be found in the patent claims.

This invention is based on the insight that it is possible to make of the mixture of graphite and fireproof material such parts of mould which have controlled electric resistance, and which thus with a safe tension and a moderate current develop the required heat. Other fireproof resistive materials such as silicon carbide and Si—C—O-compounds, act like graphite, but their manufacturing price make them less advantageous. The hydraulically or chemically binding concretes are suitable for the basic material of fireproof resistive parts, their cement or binding material being alumina cement, Portland Cement, water-glass, phosphoric acid, magnesia or doloma cement. The hardened fireproof resistive concrete is made from these cements and graphite like corresponding fireproof concrete.

The resistivity of graphite concrete is about $0.001 \times c^{-5}$ ohm $\times$ cm, where $c$ = concentration of graphite.

Graphite concrete, such as corresponding fireproof concrete, must be dried after hardening to prevent the explosion caused by steam pressure during the heating phase. The temperature rise in hot-pressuring is very fast and therefore a careful drying as well as the evaporating of chemically bound water is necessary. In the heating system there are thus two very different resistive composites. The mould, the compacted powder and the punch are very low-resistive and with few possibilities of choice. Often the punch, and especially a thin-walled punch, becomes too hot with the current necessary for heating the mould and compact.

The other resistive composite, the above mentioned parts of moulds, which have controlled electric resistance, can be freely chosen high-resistive and thus the following advantages are obtained:

- A moderate and remarkably lower current than mentioned in the introduction and a safe tension, like 2 . . . 200 V, or more conveniently 5 . . . 20 V, can be used.
- The heat, fully controlled, is generated in the right places
- Simultaneously with the compacting can be obtained the fixing of the compact to the punch or to the mould, according to requirements
- The using of steel and hard metal moulds is self explanatory The utilization of this invention is favoured by the wide distribution of the power source needed. A safe tension of 20 . . . 50 volts and efficiency enough can be obtained from many normal welding apparatus. It is easy to calculate and to test under these conditions the right resistivity for the graphite concrete.

Figure 2:
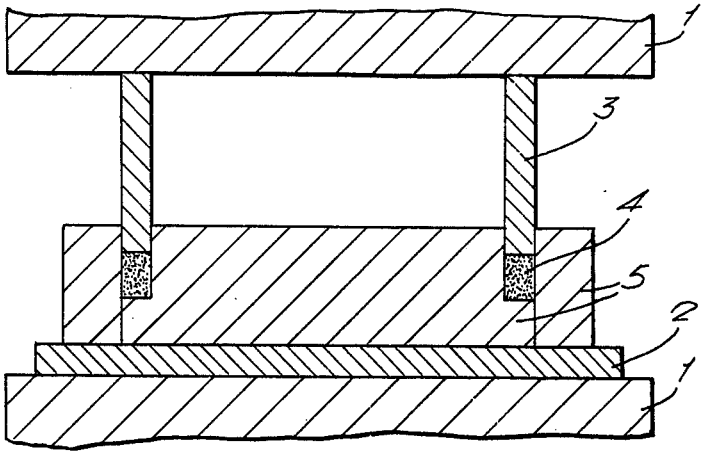

In the sectional Figs. 1 and 2 are shown schematically the typical solutions which are different from each other.

In both figures the hot pressing is made between two electrodes 1, of which the current of safe tension is obtained. FIG. 1 shows the manufacturing of a grinding wheel, where the metal punch 3 is strong and short and does not buckle even when hot. The circuit here is low-resistive, and so the solution without extra resistors 2 would require a very high current. In this solution two resistors 2 make the heat conduction even and the heated parts do not become weak.

FIG. 2 shows the manufacturing of a drill core bit. A long and thinwall tube 3 acting in this case as punch might easily buckle and very little additional heat can be developed in it. One heating resistor 2 must be sufficient and it might be necessary to cool tube 3 or it must be strengthened during the hot pressing so that it has much allowance for machining.

The resistive composites used in this method are plates of even thickness, and by a plate thickness of merely 5 to 10 mm an even heat development can be achieved and the appearance of the electric arc can be prevented. In practice, the resistive plates 2 and the compact 4 are subjected to the same force which is rather high, but the resistive composite must not break from that. This kind of strong resistive plate can be made of the mixture of graphite powder, alumina cement and asbestos. After wetting and pressing by a pressure of 100 . . . 200 bar, this mixture is left to harden and finally to be dewatered.

This invention thus relates to such a powder metallurgic hot pressing method where the heating of pressure mould 5 and the metallic powder mixture 4 therein is produced by conducting the electric current through them as well as through one or several resistive graphite containing bodies 2 in contact with mould 5, in which resistive bodies the heat thus produced is transferred into mould 5 and into the metallic powder mixture 4. The metallic powder mixture in the above mentioned examples consists of cobalt and/or iron and natural and/or synthetic diamond. The invention is naturally not limited to these embodiments but can be modified in many ways within the scope of claims.

I claim:

1. In a powder metallurgical manufacturing process, where metal powder or a metal powder mixture is compressed and heated in a mould and the mould and the metal powder are cold at the beginning of the process and where heat is produced by conducting electric current through the mould and the metal powder as well as through at least one electrically resistive fireproof body in outer contact with the mould, in which body the heat thus produced is transferred into the mould and into the metal powder the improvement wherein:

(a) the electric tension is between 2 and 200 V;

(b) the current efficiency per unit volume of the mould is between 20 and 200 $W/cm^3$; and (c) the resistivity of the electrically resistive fireproof body is between 0.03 and 100 ohm $\times$ cm.

2. In a process as claimed in claim 1, wherein:

(a) the electric tension is between 5 and 50 V;

(b) the current efficiency per unit volume of the mould is between 50 and 100 $W/cm^3$; and (c) the resistivity of the electrically resistive fireproof body is between 0.1 and 10 ohm $\times$ cm.

3. In a process as claimed in claim 1, characterized in that the resistive fireproof body consists of graphite and concrete.

4. In a process as claimed in claim 3, wherein the graphite is present in an amount in the range of from 15% to 40% and the concrete is present in an amount in the range of from 60% to 85%, said percentages being based upon the total weight of said body.

* * * * *